US007127879B2

(12) United States Patent
Zhu et al.

(10) Patent No.: US 7,127,879 B2
(45) Date of Patent: Oct. 31, 2006

(54) PLY-TWISTED YARN FOR CUT RESISTANT FABRICS

(75) Inventors: Reiyao Zhu, Midlothian, VA (US); Richard H. Young, Richmond, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 297 days.

(21) Appl. No.: 10/264,006

(22) Filed: Oct. 3, 2002

(65) Prior Publication Data

US 2004/0065072 A1 Apr. 8, 2004

(51) Int. Cl.
*D02G 3/02* (2006.01)

(52) U.S. Cl. ..... 57/236; 57/240

(58) Field of Classification Search ..... 57/236–242
See application file for complete search history.

(56) References Cited

U.S. PATENT DOCUMENTS

| | | | | |
|---|---|---|---|---|
| 2,448,782 A | | 9/1948 | Davis | |
| 3,603,071 A | * | 9/1971 | O'Neil et al. | 57/238 |
| 3,831,368 A | * | 8/1974 | Glowacki | 57/239 |
| 4,004,295 A | | 1/1977 | Byrnes, Sr. | |
| 4,155,394 A | * | 5/1979 | Shepherd et al. | 152/527 |
| 4,470,251 A | | 9/1984 | Bettcher | |
| 4,877,073 A | * | 10/1989 | Thise et al. | 152/451 |
| 5,119,512 A | | 6/1992 | Dunbar et al. | |
| 5,224,363 A | * | 7/1993 | Sutton | 66/202 |
| 6,381,940 B1 | * | 5/2002 | Kolmes et al. | 57/245 |
| 6,534,175 B1 | * | 3/2003 | Zhu et al. | 428/365 |

FOREIGN PATENT DOCUMENTS

| | | |
|---|---|---|
| EP | 0 445 872 A | 9/1991 |
| GB | 2324100 | 10/1998 |
| WO | WO 93 24689 A | 12/1993 |
| WO | WO 9727769 | 8/1997 |
| WO | WO 200186046 | 11/2001 |

OTHER PUBLICATIONS

Ali Demir, Synthetic Filament Yarn Texturing Technology, Prentice Hall, 1st edition, pp. 41 and 42.*

* cited by examiner

*Primary Examiner*—Shaun R Hurley

(57) ABSTRACT

A ply-twisted yarn useful in cut resistant fabrics is made by providing a first multifilament yarn of continuous organic filaments having a tensile strength of at least 4 grams per denier and having a twist in a first direction of from 0.5 to 10 turns per inch; providing a second yarn comprising 1 to 5 continuous inorganic filament(s); and ply-twisting the first yarn and the second yarn about each other 2 to 15 turns per inch in a second direction opposite to that of the twist in the first yarn to form a ply-twisted yarn having an overall effective twist of +/−5 turns per inch.

21 Claims, 2 Drawing Sheets

PLY-TWISTED YARN FOR CUT RESISTANT FABRICS

BACKGROUND OF THE INVENTION

This invention relates to a cut-resistant ply-twisted yarn and fabrics made from that yarn that are useful in protective garments, especially garments known as turnout gear which are useful for firefighters, but such fabrics and garments also have use in industrial applications where workers may be exposed to abrasive and mechanically harsh environments where fire and flame protection is needed. The garments, which include coats, coveralls, jackets, and/or pants can provide protection against fire, flame, and heat.

Most turnout gear commonly used by firefighters in the United States comprise three layers, each performing a distinct function. There is an outer shell fabric often made from flame resistant aramid fiber such as poly (meta-phenylene iosphthalamide) (MPD-I) or poly (para-phenylene terephthalamide) (PPD-T) or blends of those fibers with flame resistant fibers such as polybenzimidazoles (PBI). Adjacent to the outer shell fabric is a moisture barrier and common moisture barriers include a laminate of Crosstech® PTFE membrane on a woven MPD-I/PPD-T substrate, or a laminate of neoprene on a fibrous woven polyester/cotton substrate. Adjacent the moisture barrier is an insulating thermal liner which generally comprises a batt of heat resistant fiber.

The outer shell serves as initial flame protection while the thermal liner and moisture barrier protect against heat stress.

Since the outer shell provides primary defense it is desirable that this shell be durable and able to withstand abrasion and resist tearing or cutting in harsh environments. This invention provides for such a fabric that is preferably flame resistant and has good tear, cut, and abrasion attributes.

There are a number of fabrics described in the prior art which utilize bare steel wires and cords, primarily as armored fabrics. For example, WO 9727769 (Bourgois et al.) discloses a protective textile fabric comprising a plurality of steel cords twisted together. WO 200186046 (Vanassche et al.) discloses a fabric comprising steel elements used to provide cut resistance or reinforcement for protective textiles. The steel elements are either a single steel wire, a bundle of non-twisted steel wires, or a cord of twisted steel fibers. GB 2324100 (Soar) discloses a protective material made from twisted multi-strand cable which may be stitched to one or more layers of Kevlar® to form a unitary material. The use of large quantities of bare metal wire presents processing challenges and garment aesthetic (comfort and feel) problems and is undesirable.

U.S. Pat. No. 4,470,251 (Bettcher) discloses a cut resistant yarn made by winding a number of synthetic fibers yarns, such as nylon and aramid, around a core of strands of stainless steel wire and a high strength synthetic fiber such as aramid, and a safety garment made from the wound yarn.

U.S. Pat. No. 5,119,512 (Dunbar et al.) discloses a protective fabric made from cut resistant yarn comprising two dissimilar non-metallic fibers,.at least one being flexible and inherently cut resistant and the other having a level of hardness at above three Mohs on the hardness scale.

While inorganic filaments such as steel can provide useful cut resistance in fabrics, incorporating those inorganic filaments into fabrics is not a trivial problem, especially when combining those inorganic filaments with other continuous organic filament yarns. Most multifilament yarns containing continuous organic filaments have initial twist to maintain cohesion of the yarn. If an inorganic filament is simply twisted into the previously twisted yarns, the final yarn is too lively, that is it has too much twist and tends to twist and wrap onto itself and snag during weaving, preventing high quality fabrics from being produced. Further, if the inorganic filament is combined with the multifilament yarn without twist or with very low twist, the resulting yarn will not have adequate cohesion to be woven. What is needed is a method of providing a twisted yarn containing both multifilament yarns of continuous filaments and continuous inorganic filaments that has low liveliness and is easily woven into a fabric.

SUMMARY OF THE INVENTION

The present invention relates to a process for making a cut-resistant ply-twisted yarn having good weaving characteristics, comprising the steps of (1) providing a first multifilament yarn comprising continuous organic filaments, said first yarn having a twist in a first direction of from 0.5 to 10 turns per inch; (2) providing a second yarn comprising 1 to 5 continuous inorganic filament(s); and (3) ply-twisting the first yarn and the second yarn about each other 2 to 15 turns per inch in a second direction opposite to that of the twist in the first yarn to form a ply-twisted yarn. Such yarn has an overall effective twist of +/−5 turns per inch. The first multifilament yarn has a tensile strength of at least 4 grams per denier, preferably at least 20 grams per denier. It is also preferred that the first yarn include aramid filaments and that the continuous inorganic filaments in the second yarn include steel filament(s).

This invention also relates to the cut-resistant ply-twisted yarn which comprises a) a first multifilament yarn comprising continuous organic filaments, said first yarn having a twist in a first direction of from 0.5 to 10 turns per inch; b) a second yarn comprising 1 to 5 continuous inorganic filament(s); the first yarn and the second yarn having a ply-twist about each other of 2 to 15 turns per inch in a second direction opposite to that of the twist in the first yarn, providing a cut-resistant ply-twisted yarn having an overall effective twist of +/−5 turns per inch. The first multifilament yarn is a yarn having a tensile strength of at least 4 grams per denier, and preferably at least 20 grams per denier. It is also preferred that the first yarn include aramid filaments and that the second yarn includes steel filament(s).

The present invention is further directed to a woven fabric useful in protective apparel made from yarn components comprising a body fabric yarn component and a cut-resistant yarn component, the cut-resistant yarn component comprising a ply-twisted yarn comprising (1) a first multifilament yarn comprising continuous organic filaments, and (2) a second yarn comprising 1 to 5 continuous inorganic filament (s); said ply-twisted yarn having an overall effective twist of +/−5 turns per inch. The body fabric yarn component and the cut-resistant yarn component are comprised of at least one yarn and each yarn component is distinguished from the adjacent yarn component by interweaving orthogonal yarn components. It is preferred that the first yarn of the cut-resistant yarn component comprises poly (p-phenylene terephthalamide) filaments. The first yarn of the cut-resistant yarn component may include fire-resistant filaments, and in addition to fire-resistant filaments, nylon fibers in an amount of up to 20% by weight of the cut-resistant yarn component may be included in the cut-resistant yarn component. It is preferred that the body fabric component comprises yarns of fire-resistant fibers. The body fabric yarn component yarn can include, in addition to fire-resistant fibers, nylon fibers in an amount of up to 20% by weight of the body fabric yarn component.

This invention is also directed to a woven fabric useful in protective apparel made from yarn components comprising a body fabric yarn component, a cut-resistant yarn component comprising a ply-twisted yarn comprising a first multifilament yarn comprising continuous organic filaments, and a second yarn comprising 1 to 5 continuous inorganic filament(s); said ply-twisted yarn having an overall effective twist of +/−5 turns per inch. The body fabric yarn component and the cut-resistant yarn component are comprised of individual warp and fill yarns in the fabric, and every fifth to ninth orthogonal warp and fill yarn component is a cut-resistant yarn component. In another embodiment of this woven fabric cut resistant yarn component is only present in either the warp or the fill yarn components but not both.

This invention is also directed to a process for making a woven fabric useful in protective apparel comprising the steps of weaving a fabric from a body fabric yarn component, and inserting into the weave at every fifth to ninth warp and fill component a cut-resistant yarn component comprising a ply-twisted yarn comprising a first multifilament yarn comprising continuous organic filaments, and a second yarn comprising 1 to 5 continuous inorganic filament(s); said ply-twisted yarn having an overall effective twist of +/−5 turns per inch.

Another embodiment of the invention is directed to a process for making a woven fabric useful in protective apparel made from warp and fill yarn components comprising weaving a fabric from a body fabric yarn component, and inserting into the weave at every fifth to ninth warp and/or fill component a cut-resistant yarn component to create an array of cut resistant yarn components, each component comprising a ply-twisted yarn comprising a first multifilament yarn comprising continuous organic filaments, and a second yarn comprising 1 to 5 continuous inorganic filament(s); said ply-twisted yarn having an overall effective twist of +/−5 turns per inch in the second direction.

DETAILED DESCRIPTION OF THE INVENTION

Figure 1:
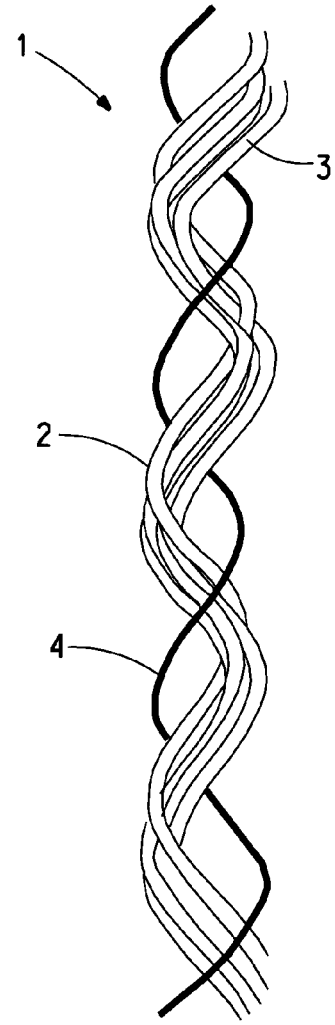
FIG. 1 is illustration of a ply-twisted yarn made from a twisted multifilament yarn of continuous organic filaments and a yarn consisting of a single inorganic filament.

This invention relates to cut-resistant ply-twisted yarn, process for making a ply-twisted yarn, fabrics containing ply-twisted yarn as a cut-resistant component, and methods for making fabric containing ply-twisted yarn as a cut-resistant component.

A ply-twisted yarn or a plied yarn is a yarn made by twisting two other yarns together, generally on a twister. Ply-twisted yarns are well known in the art and are twisted about one another in a simple manner and upon inspection is it clear that a ply-twisted yarn is composed of separate yarns. Ply-twisted yarns are generally more flexible, and therefore more desirable for apparel, than yarns made by completely winding or wrapping one yarn with another yarn by serving one yarn around the other yarn. These wrapped yarns have a sheath/core structure and are not plied yarns.

Improved cut resistance can be had by the addition of only a few inorganic filaments to a multifilament yarn made of continuous organic filaments. In fact, the addition of only 1 metal filament provides a substantial increase in the cut resistance of fabrics made from such yarns. However, it is desirable to incorporate that yarn as much as possible into the organic multifilament bundle to increase the cohesiveness of the yarn and allow the inorganic-reinforced yarn to process in weaving equipment as though the inorganic or metal filament(s) was (were) not present.

Typically, cohesiveness is provided to continuous filament yarns via twist. However, the combination of the inorganic filament yarn having only a few filaments, with a larger multifilament yarn with many filaments, presents some unique problems. The larger multifilament yarn already has a level of twist to provide it with cohesiveness. When the small inorganic filament yarn is combined with the larger multifilament yarn, additional twist is added to the multifilament yarn. This results in an unacceptable level of twist in the final yarn, and such yarns are said to be too lively to be woven efficiently into fabrics. That is, the yarns have so much twist that if one were to hold either end of the yarn with minimal tension the yarn would tend to twist and wrap around itself creating knots. These same knots would form and snag in processing equipment.

The ply-twisted yarn of this invention contains a first multifilament yarn of continuous organic filaments having a twist in a first direction of 0.5 to 10 turns per inch. The ply-twisted yarn in addition contains a second yarn comprising 1 to 5 continuous inorganic filament(s). The first and second yarns are ply-twisted together 2 to 15 turns per inch in a second direction, which is opposite to the twist direction in the first yarn, giving the ply-twisted yarn an effective twist level in the range of +/−5 turns per inch. By "effective twist level" it is meant the algebraic sum of the turns per inch, taking the multifilament twist direction as being negative and the ply twist direction as being positive. For example, if the multifilament yarn has twist level of 5 turns per inch in one direction and the ply twist level is 7 turns per inch in the opposite direction, the effective twist level is −5+7=2 turns per inch. If the multifilament yarn has a twist level of 4 turns per inch and the ply twist level is 2 turns per inch in the opposite direction the effective twist level is −4+2=−2 turns per inch.

It is desirable that the effective twist level be between −2 and 2 and it is preferred that the effective twist level be positive. It is believed that positive effective twist levels provide more cohesiveness and mixing of the smaller inorganic yarn with the larger multifilament yarn due to partial unwrapping of the multifilament continuous filament yarn during ply-twisting.

The multifilament continuous filament yarn should have a tensile strength of at least 4 grams per denier and it is preferred that the yarn contain filaments which are fire-resistant. Suitable fire-resistant filaments include those made from aramids such as poly (para-phenylene terephthalamide) (PPD-T), poly(meta-phenylene isophthalamide) (MPD-I), and other high strength polymers such as polyphenylene benzobisoxazole (PBO) and/or blends or mixtures of those fibers. Multifilament continuous yarns having a tensile strength of at least 20 grams per denier are preferred and the preferred high strength cut resistant filaments are made from PPD-T. The multifilament yarn can also include some other materials to the extent that decreased cut resistance, due to that other material, can be tolerated. For example the multifilament yarn can also have, combined with or in addition to the cut resistant filaments, up to 20 percent by weight nylon filaments for improved abrasion resistance.

The multifilament continuous filament yarn has preferably a denier in the range of 200 to 1000 denier, and after ply-twisting with the inorganic filaments the cut resistant ply-twisted yarn has a denier preferably in the range of 320 to 1400 denier. The continuous organic multifilament yarn is ply-twisted with a yarn containing 1 to 5 continuous inorganic filaments. Inorganic filaments useful in this invention include glass filaments or filaments made from metal or metal alloys. The preferred continuous inorganic filament yarn is a single metal filament made from stainless steel. By metal filament is meant a filament or wire made from a ductile metal such as stainless steel, copper, aluminum, bronze, and the like. The metal filaments are generally continuous wires and are 10 to 150 micrometers in diameter, and are preferably 25 to 75 micrometers in diameter. The preferred inorganic filament is a 35 micrometer (1.5 mil) diameter stainless steel filament. The preferred ply-twisted yarn is constructed by combining a 600 denier PPD-T continuous filament yarn having 2 turns per inch in the "S" direction with a continuous metal filament yarn containing one 35 micrometer (1.5 mil) diameter stainless steel filament and ply-twisting the two yarns 4 turns per inch in the "Z" direction, resulting in a ply-twisted yarn having a effective twist level of 2.

FIG. 1 is an illustration of a ply-twisted yarn 1 of this invention. The ply-twisted yarn is made from a first multifilament continuous filament yarn 2 having filaments 3 twisted in a first direction. The multifilament yarn is plied in the opposite direction with a second yarn comprising 1 to 5 continuous inorganic filament(s). Shown in the figure is one continuous inorganic filament 4.

The fabrics made with the ply-twisted yarn of this invention have in combination improved cut resistance and improved tear resistance over prior art fabrics and preferably have improved abrasion resistance. The fabrics are woven using known machines for weaving fabric and can be incorporated into protective apparel and garments of various types. These fabrics typically weigh in the range of 4 to 12 ounces per square yard and can be any orthogonal weave, however plain weave and 2×1 twill weave are the preferred weaves.

This invention comprises two types of yarn components, a body fabric yarn component and a cut resistant yarn component having incorporated therein a cut resistant ply-twisted yarn. The body yarn component can be a yarn, a plied yarn, or a combination of yarns or a combination of plied yarns. The cut resistant yarn component can have, in addition to the ply-twisted yarn, another yarn, plied yarn, combination of yarns, or combination of plied yarns. In general, each yarn component lying in one direction of a woven fabric is distinguished from the adjacent yarn component in that same direction by interweaving orthogonal yarn components. In a plain weave, for example, the warp and fill yarn components are interwoven wherein the warp yarn components go over and under the fill yarn components, delineating each fill yarn component and distinguishing it from the adjacent fill yarn component. Likewise, adjacent warp yarn components alternate the direction of the interweave with the fill yarn; that is, a first warp yarn component will go over a fill yarn component and a second adjacent warp yarn component will go under that same fill yarn component. This alternate interweaving action is duplicated throughout the fabric creating the classic plain weave structure. Therefore, the fill yarn components also delineate each warp yarn component from adjacent warp yarn components. In a twill weave, the warp and fill yarn components are interpreted the same even though there is less actual interweaving of warp and fill yarn components. In a 2×1 twill weave, the offset staggered interweaving structure of that weave means a warp yarn component passes over more than one fill yarn component and lies directly adjacent to another warp yarn component periodically in the fabric. However, the warp and fill yarn components are still delineated by each other even if they are offset or staggered in the fabric, and the yarn components can be clearly identified by inspection.

Typically, the major portion of the fabric is made from body fabric yarn components and these components normally comprise yarns containing fire-resistant fibers. The term "fire resistance fibers" as used herein means staple or filament fibers of polymers containing both carbon and hydrogen and which may also contain other elements such as oxygen and nitrogen, and which have a LOI 25 and above. Suitable fire-resistant fibers include poly (meta-phenylene isophthalamide) (MPD-I), poly (para-phenylene terephthalamide) (PPD-T), polybenzimidazoles (PBI), poly-phenylene benzobisoxazole (PBO), and/or blends or mixtures of those fibers. For improved abrasion resistance, the body fabric yarn components can have in addition to the fire-resistant fibers up to 20 percent by weight nylon fibers, preferably less than 10 percent by weight. The body fabric yarn components are preferably staple yarns containing 60 weight percent PPD-T fiber and 40 weight percent PBI fiber. The preferred form and size of the body fabric yarn component is a plied yarn of the above composition having a cotton count in the range of 16/2 to 21/2.

The cut-resistant yarn component of the fabric is useful in providing both cut resistance and tear strength to the fabric. The cut resistant yarn component contains at least one cut resistant ply-twisted yarn comprising a first multifilament yarn of continuous organic filaments having a twist in a first direction plied with a second yarn comprising 1 to 5 continuous inorganic filament(s). The first and second yarns are plied together in a second direction which is opposite to the first direction. It is preferred that the cut resistant yarn component contain filaments which are fire-resistant. Suitable fire-resistant filaments include those made from aramids such as poly (para-phenylene terephthalamide) (PPD-T), poly(meta-phenylene isophthalamide) (MPD-I), and other high strength polymers such as poly-phenylene benzobisoxazole (PBO) and/or blends or mixtures of those fibers. The preferred fire resistant and cut resistant fiber is PPD-T fiber. The yarn can also include some fibers of other materials to the extent that decreased cut resistance, due to that other material, can be tolerated. The cut resistant yarn component can also have, incorporated in the multifilament continuous filament yarn, or in the plied yarn as a separate entity, up to 10 weight percent and as much as 20 percent by weight nylon fiber for improved abrasion resistance.

The total denier of the cut resistant yarn component may be in the range of 320 denier to 1400 denier and the denier of continuous organic multifilament yarns suitable for use in the cut resistant yarn component may be in the range of 200–1000 denier. The continuous organic multifilament yarn is plied with a yarn containing 1 to 5 continuous inorganic filaments. Inorganic filaments useful in this invention include glass filaments or filaments made from metal or metal alloys. The preferred continuous inorganic filament yarn is a single metal filament made from stainless steel. By metal filament is meant a filament or wire made from a ductile metal such as stainless steel, copper, aluminum, bronze, and the like. The metal filaments are generally continuous wires and are 10 to 150 micrometers in diameter, and are preferably 25 to 75 micrometers in diameter.

Figure 2:
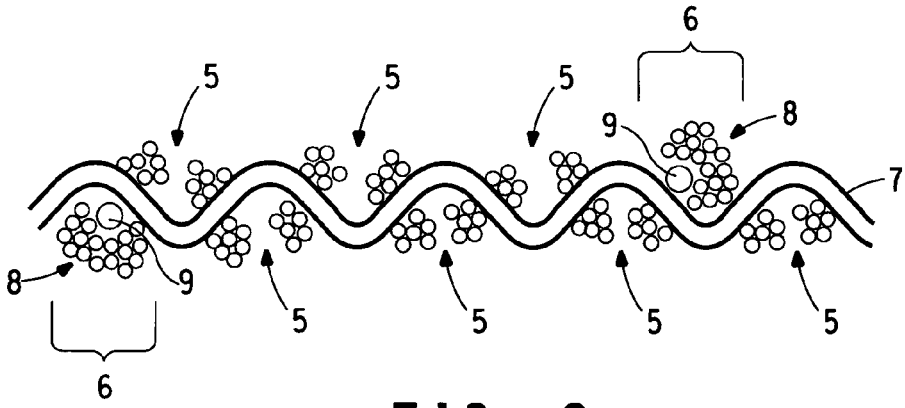
FIG. 2 is an illustration of some of the possible yarn components in the fill direction separated by interweaving orthogonal warp yarn components in the fabric of this invention.

FIG. 2 is a very simplified illustration of some of the possible fill yarn components separated by interweaving orthogonal warp yarn components (filament diameters in the yarns are not to scale but magnified for illustration purposes). Body fabric yarn components 5 made from, for example, a collection of two plied staple yarns, are shown separated from such things as other body yarn components and cut resistant yarn components 6 by the interweaving warp yarn component 7. Cut resistant yarn component 6 is shown having the preferred combination of types of yarns, namely a ply-twisted yarn of multifilament continuous organic filaments 8 and a inorganic filament yarn containing one stainless steel filament 9. The body fabric yarn component 5 can be made up from a combination of single yarns and/or plied yarns. Similar types of yarn components can be, and preferably are, present in the warp direction.

Figure 3:
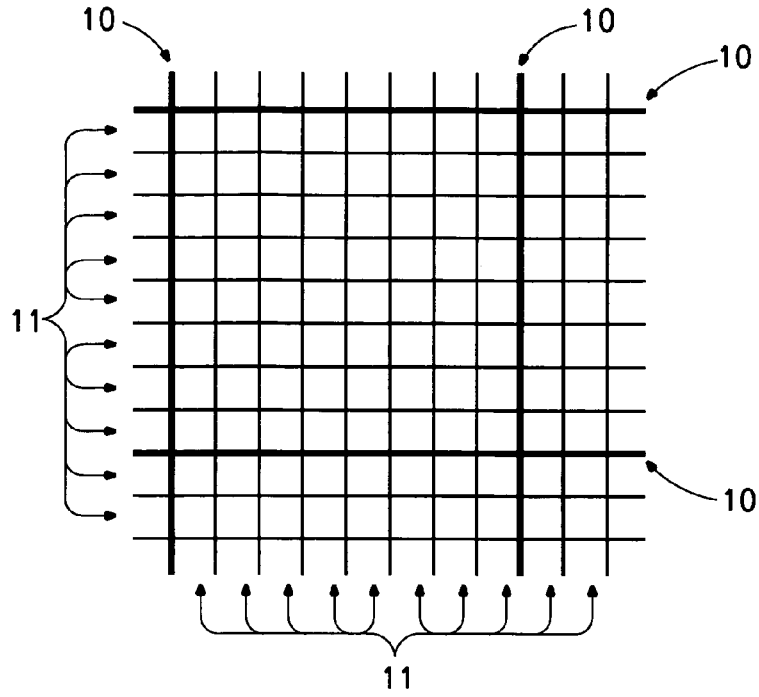
FIG. 3 is an illustration of one embodiment of the fabric of this invention.

The woven fabric of this invention typically has a predominance of body fabric yarn components with only enough of the cut resistant yarn components to allow the fabric to perform in the fabric's intended use. It is desirable to have cut resistant yarn components in both the warp and fill directions. Further, it is desired to uniformly distribute the cut resistant yarn components throughout the fabric in both the warp and fill directions so that the durability imparted by the cut resistant yarn component is uniform across the fabric. Further, it is believed that the most useful fabrics are made when the cut resistant yarn component is distributed in the fabric as every fifth to ninth orthogonal warp and fill yarn component in the fabric, with the preferred spacing having a cut resistant yarn component every seventh warp and fill yarn component. FIG. 3 is an illustration of one embodiment of the fabric of this invention with the warp and fill yarn components shown broadly separated and simplified for illustration purposes. Cut resistant yarn components 10 are shown in both the warp and fill and are present as every eighth component in the fabric. Body fabric yarn components 11 are shown in both the warp and fill between the cut resistant yarn components.

This invention is also directed to a process for making a cut resistant woven fabric comprising weaving a fabric from a body fabric yarn component and inserting into the weave at every fifth to ninth warp and fill component a cut resistant yarn component comprising the cut resistant ply-twisted yarn of this invention.

Figure 4:
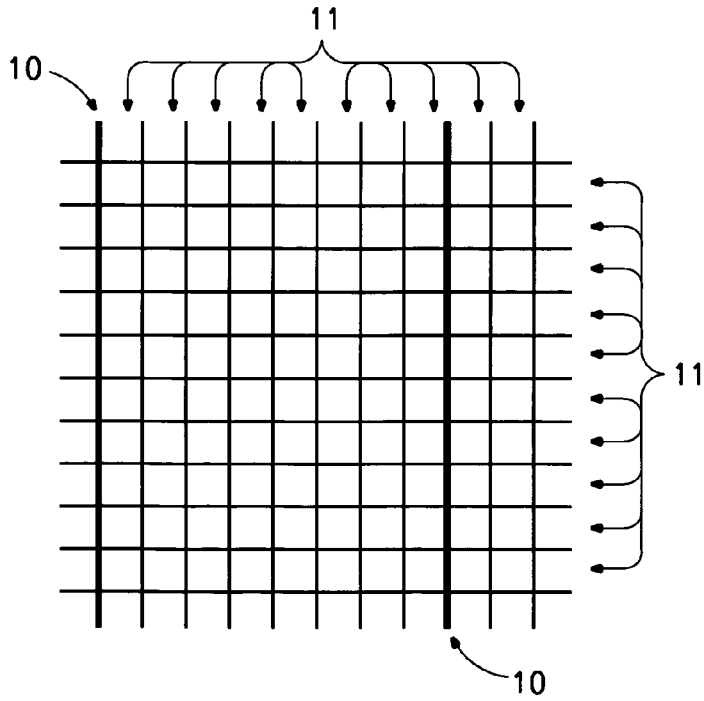
FIG. 4 is an illustration of another embodiment of the fabric of this invention.

In another embodiment of this invention, the woven fabric of this invention is made from body fabric yarn components and cut resistant yarn components wherein the cut resistant yarn components are present in only the warp or the fill of the fabric, creating a parallel array of those cut resistant components in the fabric. FIG. 4 is an illustration of this type of fabric. The cut resistant yarn components 10 are shown only in the warp direction and all other warp yarns are body fabric yarn components 11. The yarn components shown in the fill direction are all body fabric yarn components 11.

The fabrics of this invention are useful in and can be incorporated into protective garments, especially garments known as turnout gear which are useful for firefighters. These garments also have use in industrial applications where workers may be exposed to abrasive and mechanically harsh environments where fire and flame protection is needed. The garments, may include coats, coveralls, jackets, pants, sleeves, aprons, and other types of apparel where protection against fire, flame, and heat is needed.

Test Methods

Thermal Protective Performance Test (TPP)

The predicted protective performance of a fabric in heat and flame was measured using the "Thermal Protective Performance Test" NFPA 2112. A flame was directed at a section of fabric mounted in a horizontal position at a specified heat flux (typically 84 $kW/m^2$). The test measures the transmitted heat energy from the source through the specimen using a copper slug calorimeter and there is no space between fabric and heat source. The test endpoint is characterized by the time required to attain a predicted second-degree skin burn injury using a simplified model developed by Stoll & Chianta, "Transactions New York Academy Science", 1971,33 p 649–670. The value assigned to a specimen in this test, denoted as the TPP value, is the total heat energy required to attain the endpoint, or the direct heat source exposure time to the predicted burn injury multiplied by the incident heat flux. Higher TPP values denote better insulation performance. A three layer testing sample is prepared consisting of outer shell fabric (current invention), a moisture barrier and a thermal liner. The moisture barrier was Crosstech® attached to a 2.7 $oz/yd^2$ (92 grams/square meter) Nomex®/Kevlar® fiber substrate and the thermal liner consisted of three spunlaced 1.5 $oz/yd^2$ (51 grams/square meter) sheets quilted to a 3.2 $oz/yd^2$ (108 grams/square meter) Nomex® staple fiber scrim.

Abrasion Resistance Test

Abrasion resistance was determined using ASTM method D3884-80, with a H-18 wheel, 500 gms load on a Taber abrasion resistance available from Teledyne Taber, 455 Bryant St., North Tonawanda, N.Y. 14120. Taber abrasion resistance is reported as cycles to failure.

Cut Resistance Test

Cut resistance was measured using the "Standard Test Method for Measuring Cut Resistance of Materials Used in Protective Clothing", ASTM Standard F 1790-97. In performance of the test, a cutting edge, under specified force, was drawn one time across a sample mounted on a mandrel. At several different forces, the distance drawn from initial contact to cut through was recorded and a graph constructed of force as a function of distance to cut through. From the graph, the force was determined for cut through at a distance of 25 millimeters and was normalized to validate the consistency of the blade supply. The normalized force was reported as the cut resistance force. The cutting edge was a stainless steel knife blade having a sharp edge 70 millimeters long. The blade supply was calibrated by using a load of 400 g on a neoprene calibration material at the beginning and end of the test. A new cutting edge was used for each cut test. The sample was a rectangular piece of fabric cut 50×100 millimeters on the bias at 45 degrees from the warp and fill directions. The mandrel was a rounded electrical conductive bar with a radius of 38 millimeters and the sample was mounted thereto using double-face tape. The cutting edge was drawn across the fabric on the mandrel at a right angle with the longitudinal axis of the mandrel. Cut through was recorded when the cutting edge makes electrical contact with the mandrel.

Tear Strength Test

The tear strength measurement is based on ASTM D 5587-96. This test method covers the measurement of the tear strength of textile fabrics by the trapezoid procedure using a recording constant-rate-of-extension-type (CRE) tensile testing machine. Tear strength, as measured in this test method, requires that the tear be initiated before testing. The specimen was slit at the center of the smallest base of the trapezoid to start the tear. The nonparallel sides of the marked trapezoid were clamped in parallel jaws of a tensile testing machine. The separation of the jaws was increased continuously to apply a force to propagate the tear across the specimen. At the same time, the force developed was recorded. The force to continue the tear was calculated from autographic chart recorders or microprocessor data collection systems. Two calculations for trapezoid tearing strength were provided: the single-peak force and the average of five highest peak forces. For the examples of this patent, the single-peak force is used.

Grab Strength Test

The grab strength measurement, which is a determination of breaking strength and elongation of fabric or other sheet materials, is based on ASTM D5034. A 100-mm (4.0 in.) wide specimen is mounted centrally in clamps of a tensile testing machine and a force applied until the specimen breaks. Values for the breaking force and the elongation of the test specimen are obtained from machine scales or a computer interfaced with testing machine.

EXAMPLE

This example illustrated the ply-twisted yarn and a fabric of this invention.

A cut resistant yarn component was made containing a ply-twisted yarn comprised of a cut resistant PPD-T multifilament yarn and a stainless steel wire yarn. The PPD-T filament fiber was 600denier Kevlar® fiber 1.5 dpf, (available from E. I. du Pont de Nemours & Co., Inc.). The stainless steel wire yarn was comprised of one 35 micrometer (1.5 mil) diameter stainless steel filament. The PPD-T multifilament yarn was first twisted on a twister to put 2 turns/inch in "s" twist direction. This twisted PPD-T multifilament yarn and the stainless steel wire were then put through the twist machine to be plied together in "z" twist direction having 4 turns/inch. By doing so, the resulted yarn had enough cohesion between steel wire and filament fiber for subsequent processing, but only and effective twist level of 2 turns/inch. This yarn processed well in all subsequent weaving steps.

A body yarn component was made using commercially available ring-spun staple yarn containing PPD-T (Kevlar®) and PBI fiber (1.5 dpf, 51 mm (2 inch)) present in a 60/40 blending ratio (obtained from Pharr Yarns, Inc., of 100 Main Street, McAdenville, N.C.). A 2/1 twill weave fabric was made. The fabric construction consisted, in order, of 5 body fabric yarn components of Kevlar®/PBI yarns followed by one cut resistant yarn component of Kevlar®filament/steel wire ply-twisted yarn. This sequence was repeated in the fabric in both warp and fill directions.

As showing in table 1, the final fabric showed high strength (both tear and grab strength) and much higher cut resistance.

TABLE 1

The testing results of the fabric sample

| Test Type | Standard Kevlar ®/PBI Kevlar ®/PBI blend with double ends in ripstop component | Example 1 5 body yarn components of Kevlar ®/PBI blend in twill weave and 1 end of Kevlar ® 600 denier plied with 35 micrometer stainless steel wire |
|---|---|---|
| Basis Wt. (g/m2) | 257.6 | 267.8 |
| Thickness (mm) | 0.66 | 0.75 |
| Trap Tear (warpxfill kg) | 13.1 × 12.3 | 71.8 × 58.7 |
| Grab Strength (warpxfill kg) | 119.4 × 105.3 | 152.1 × 163.9 |
| Abrasion (cycles) | 184 | 232 |
| Cut Resistance (g) | 469 | 715 |
| TPP (cal/cm^2) | 42 | 39.3 |

What is claimed is:

1. A process for making a cut-resistant ply-twisted yarn comprising:

a) providing a first multifilament yarn having a tensile strength of at least 4 grams per denier and comprising continuous organic filaments, said first yarn having a twist in a first direction of from 0.5 to 10 turns per inch;

b) providing a second yarn comprising 1 to 5 continuous inorganic filament(s); and c) ply-twisting the first yarn and the second yarn about each other 2 to 15 turns per inch in a second direction opposite to that of the twist in the first yarn to form a ply-twisted yarn having an overall effective twist of +/−5 turns per inch.

2. The process of claim 1 wherein the ply-twisted yarn has an overall effective twist of +/−2 turns per inch.

3. The process of claim 1 wherein the ply-twisted yarn has a positive overall effective twist.

4. The process of claim 1 wherein the first yarn is a yarn having a tensile strength of greater than 20 grams per denier.

5. The process of claim 1 wherein the first yarn comprises aramid filaments.

6. The process of claim 1 wherein the second yarn comprises steel filament(s).

7. The process of claim 3 wherein the first yarn comprises aramid filaments and the second yarn comprises steel filament(s).

8. A cut-resistant ply-twisted yarn comprising:

a) a first multifilament yarn having a tensile strength of at least 4 grams per denier and comprising continuous organic filaments, said first yarn having twist in a first direction of from 0.5 to 10 turns per inch;

b) a second yarn comprising 1 to 5 continuous inorganic filament(s); and c) the first yarn and the second yarn having a ply-twist about each other of 2 to 15 turns per inch in a second direction opposite to that of the twist in the first yarn, said cut-resistant ply-twisted having an overall effective twist of +/−5 turns per inch.

9. The ply-twisted yarn of claim 8 having an overall effective twist of +/−2 turns per inch.

10. The ply-twisted yarn of claim 8 having a positive overall effective twist.

11. The ply-twisted yarn of claim 8 herein the first yarn is a yarn having a tensile strength of at least 20 grams per denier.

12. The ply-twisted yarn of claim 8 wherein the first yarn comprises aramid filaments.

13. The ply-twisted yarn of claim 8 wherein the first yarn of the cut-resistant yarn component comprises poly (p-phenylene terephthalamide) filaments.

14. The ply-twisted yarn of claim 8 wherein the inorganic filaments comprise steel filament(s).

15. The ply-twisted yarn of claim 8 wherein the first yarn comprises aramid filaments and the second yarn comprises steel filament(s).

16. A woven fabric useful in protective apparel made from yarn components comprising:

a body fabric yarn component, a cut-resistant yarn component comprising a ply-twisted yarn comprising a first multifilament yarn having a tensile strength of at least 4 grams per denier and comprising continuous organic filaments, and a second yarn comprising 1 to 5 continuous inorganic filament(s); said ply-twisted yarn having an overall effective twist of +/−5 turns per inch, the body fabric yarn component and the cut-resistant yarn component each being comprised of at least one yarn and each yarn component distinguished from the adjacent yarn component by interweaving orthogonal yarn components.

17. The woven fabric of claim 16 wherein the ply-twisted yarn has a positive overall effective twist.

18. The woven fabric of claim 16 wherein the first yarn of the cut-resistant yarn component comprises fire-resistant filaments.

19. The woven fabric of claim 16 wherein the first yarn of the cut-resistant yarn component comprises poly (p-phenylene terephthalamide) filaments.

20. The woven fabric of claim 18 wherein the cut-resistant yarn component comprises, in addition to fire-resistant filaments, nylon fibers in an amount of up to 20% by weight of the cut-resistant yarn component.

21. The fabric of claim 16 wherein the body fabric yarn component comprises yarns of fire-resistant fibers.

* * * * *